United States Patent [19]

Hartmann

[11] 4,304,234

[45] Dec. 8, 1981

[54] NON-WOVEN FABRICS OF POLYOLEFIN FILAMENT AND PROCESSES OF PRODUCTION THEREOF

[75] Inventor: Ludwig Hartmann, Kaiserslautern, Fed. Rep. of Germany

[73] Assignee: Carl Freudenberg, Fed. Rep. of Germany

[21] Appl. No.: 135,699

[22] Filed: Mar. 31, 1980

[30] Foreign Application Priority Data

Jun. 19, 1979 [DE] Fed. Rep. of Germany ..... 2924539

[51] Int. Cl.[3] ..... D04H 1/58

[52] U.S. Cl. ..... 128/287; 264/75; 428/198; 428/288; 428/292; 428/296

[58] Field of Search ..... 428/198, 296, 288, 292; 156/72, 272; 264/75; 128/287

[56] References Cited

U.S. PATENT DOCUMENTS

| | | | |
|---|---|---|---|
| 3,509,009 | 4/1970 | Hartmann | 428/296 |
| 3,554,854 | 1/1971 | Hartmann | 264/72 |
| 4,107,374 | 8/1978 | Kusunose | 428/296 |

*Primary Examiner*—Marion McCamish
*Attorney, Agent, or Firm*—Keil & Witherspoon

[57] ABSTRACT

Spun, non-woven fabrics from bonded polyolefin filaments deposited in a random fashion and comprising individual filaments and filament groups of at least two parallelized individual filaments, and at least a portion of the individual filaments and filament groups are modified by polar groups in ethylene oxide and/or propylene oxide adducts, added in the nature of fibrillae on the filament or filament group surfaces or by surface treatment thereof with ethylene oxide adducts of propylene oxide block polymers with at least 20% by weight of ethylene oxide; and processes for the production of such spun, non-woven fabrics wherein the polyolefin filaments are extruded from a multiplicity of spinnerets, which are then deposited in random fashion as a mixed fleece of individual and groups of parallelized filaments and wherein, during or after extrusion, adducts of the propylene oxide and/or of the ethylene oxide are added to the filaments and/or filament groups, after which the mixed fleece thus produced is bonded by autogenous bonding.

14 Claims, 2 Drawing Figures

NON-WOVEN FABRICS OF POLYOLEFIN FILAMENT AND PROCESSES OF PRODUCTION THEREOF

Figure 1:
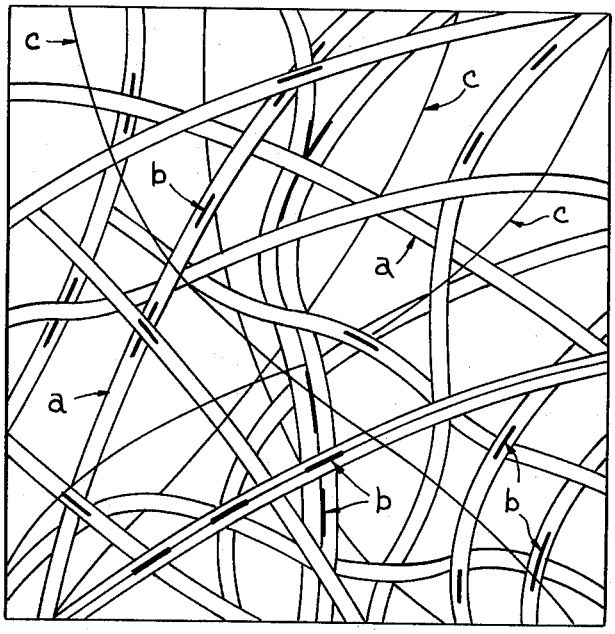

Spun, non-woven fabrics from polyolefin filaments are known per se. The production of such spun, non-woven fabrics may be accomplished, for example, in accordance with processes described in German Pat. Nos. 1,282,590, 1,303,569 and 1,435,461. The processing technique for spun, non-woven fabrics described in the previously stated patents is directed to an increase of the uniformity of the deposition of the filaments and a lowering of the weight per unit area. Thus, for example, spun, non-woven fabrics of high uniformity down to weights per unit area of 5 g/m$^2$ are described which, whenever they consist of polyolefins, may be used, because of their favorable raw material costs, for typical disposable uses in the fields of medicine and hygiene.

Especially for the last mentioned use, it is necessary to increase the wetability of the polyolefin filaments, which are basically hydrophobic and to make the spun, non-woven fabrics completely, or partly from surface active polyolefin filaments. It is furthermore necessary to control the pore size of such spun, non-woven fabrics differently from fabrics for other uses, in order to further improve the product characteristics by maintaining a certain pore volume of the fabric, as well as providing for wettability of the filaments. In U.S. Pat. No. 3,509,009, the proposal is made (column 15, line 52) to carry out the spinning process for the production of spun, non-woven fabrics under a mild oxidation of the filament or fiber surface. The adhesion of binders on surfaces treated in that way is improved.

THE INVENTION

The invention relates to developing a spun, non-woven fabric of polyolefin filaments which has a considerably improved surface treatment, whereby first of all an enrichment of the fabric surface with oxygen containing compounds is achieved.

The objectives of the invention are achieved by a spun, non-woven fabric with individual filaments and filament groups of at least two parallelized, individual filaments wherein the individual filaments and filament groups are modified at least in part by polar groups. Adducts of the propylene oxide and/or ethylene oxide are particularly recommended. They are inserted into the filaments or are applied superficially on the filaments.

The basic filaments are hydrophobic polymerizates of the type $$-CH_2-\overset{CH_3}{\overset{|}{C}}H-CH_2-\overset{CH_3}{\overset{|}{C}}H- \text{ or } -CH_2-CH_2-CH_2-CH_2-$$

The filaments of the spun, non-woven fabric should, according to the invention, be modified at least at their surface with polar groups. The modification is accomplished especially by the introduction of oxygen atoms into the polypropylene chain in the form of polypropylene oxides and by the hydrophilic polymerizates of the type of the polypropylene glycol polyoxyethylates.

$$HO-(CH_2-CH_2-O)_x-(CH_2-\overset{CH_3}{\overset{|}{C}}H-O)_y-.$$

Furthermore, substances of the following classes may also be used for the modification of the fiber surface, e.g., in the case of polyethylene filaments, polyethylene glycol adducts of the following types:

$-CH_2-O-(C_2H_4O)_x-C_2H_4-OH$
fatty alcohol polyoxyethylates

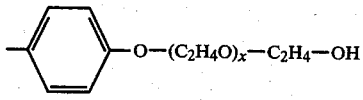

alkyl phenol polyoxyethylates
$-CO-(C_2H_4O)_x-C_2H_4\ OH$
fatty acid polyoxyethylates
$-CONH-(C_2H_4O)_x-C_2H_4-OH$
fatty acid amide polyoxyethylates The types of compounds are oxygen-containing, chain-like, nonionogenic, compounds. The lines in the formulas designate aliphatic chains e.g., alkyl, of various length, for example, 1-20 carbon atoms, such as the grouping $-C_{17}H_{35}$.

Of particular interest is the modification of the polypropylene filaments or of the filament groups with polypropyleneglycol polyoxyethylates, described later, as an example according to the invention, of the outer-surface active, spun, non-woven fabrics. In this case, the modification of the polypropylene filament structure is continued even further with polypropylene oxide. The insertion of oxygen-/carbon chains is continued in the following direction (a-b-c) and at the same time the polar character is increased:

$$-CH-\overset{CH_3}{\overset{|}{C}}H-CH-\overset{CH_3}{\overset{|}{C}}H- \quad \text{a.}$$

$$-O-CH_2-\overset{CH_3}{\overset{|}{C}}H-O-CH_2-\overset{CH_3}{\overset{|}{C}}H- \quad \text{b.}$$

$$HO-(CH_2-CH_2-O)_x-(CH_2-\overset{CH_3}{\overset{|}{C}}H-O)_y-(CH_2-CH_2-O)_z-H \quad \text{c.}$$

Here one may visualize a core structure of the polypropylene filament with increasing oxygen content toward the outermost surfaces, where appear the polypropylene or polyethylene glycols. Similar hydrophila modifications are valid for polyethylene filaments.

One of the embodiments of the invention involves adding to all or to a part of the polyolefin filaments or filament groups polyethylene oxides or polypropylene oxides during extrusion. In the filament spinning processes, there is a tendency of these so-called carbowaxes, based on rheological conditions, to migrate outward to the sheath of the filament. In order to reinforce the outer surface-active effect, it is feasible, after deposition of the filaments and of the filament groups, to apply adducts of the polypropylene oxide or polyethylene oxide, for example, substances of the type of the aforesaid polypropylene glycol polyoxyethylates, alkyl phenol polyoxyethylates, etc., to the spun non-woven fabrics, as described initially and shown in the foregoing formulas. These substances may also be applied to the unmodified polypropylene filaments after extrusion and formation of the fleece. In such case the adhesion of these outer surface active substances on the hydrophobic polypropylene is not as high as on the polypropylene modified by oxygen. In some cases, this is desirable, as will be explained later. Especially in the manufacture of the spun, non-woven fabric from filament groups of higher filament numbers, it is possible to insert aqueous emulsions of ethylene oxide or propylene oxide adducts between the filaments of the parallelized filament groups by the action of surface tension in such a way that the adducts are distributed along the filament groups.

A stereo-regular structure exists in the case of polypropylene. It also exists in the case of a few oxygen modified chain molecules because of the asymmetric carbon atoms, which is essential for the use of the substances for the production of outer surface active polypropylene filaments. It could be shown, that the polymerizates of l-propylene oxide (produced with solid KOH catalyst) produced a solid substance, whereas the d,l-polymerizates of the same molecular weight were fluid. The steric configuration also plays a role for the outer surface active polypropylene oxide layers, as it does for the isotactic polypropylene which constitutes the basic filament. By the increase of the molecular weight, a solid crystalline d,l-propylene oxide polymerizate may also be produced. In some cases, the crystallinity of the surface is not desirable for the processing of spun non-woven fabrics.

Beside the sheath-core structure of the surface modification however, a fibril-like structure is also possible for the achievement of outer surface active polyolefin filament surfaces. It is not necessary for the achievement of an outer surface active effect to activate the entire surface of the filaments and thus of the spun, non-woven fabrics built up therefrom. Rather, it is sufficient for many purposes in practice to activate only part of the surfaces of the filaments. Depending on the necessity, the degree of the surface activation may be controlled by the percentage in which these outer surface active areas, for example, active fibrils, form the surface of the filaments. Especially preferred is the embodiment in which the fibril-like areas of the surface modification are formed along the parallel individual filaments of the filament groups. The polarity of the surface may be increased in the extrusion of polyolefin filaments and their deposition into a spun non-woven fabric of the entire spinning mass, e.g., isotactic polypropylene, by adding more strongly polar chain forming substances. For example, with polypropylene oxide, isotactic polypropylene in the spinning process, wherein the molten mass is forced from the spinning holes of the spinnerets, is enriched on the basis of the rheological conditions or the flow profile with fibrillae on parts of the surface of the filaments.

PREFERRED EMBODIMENTS

Figure 2:
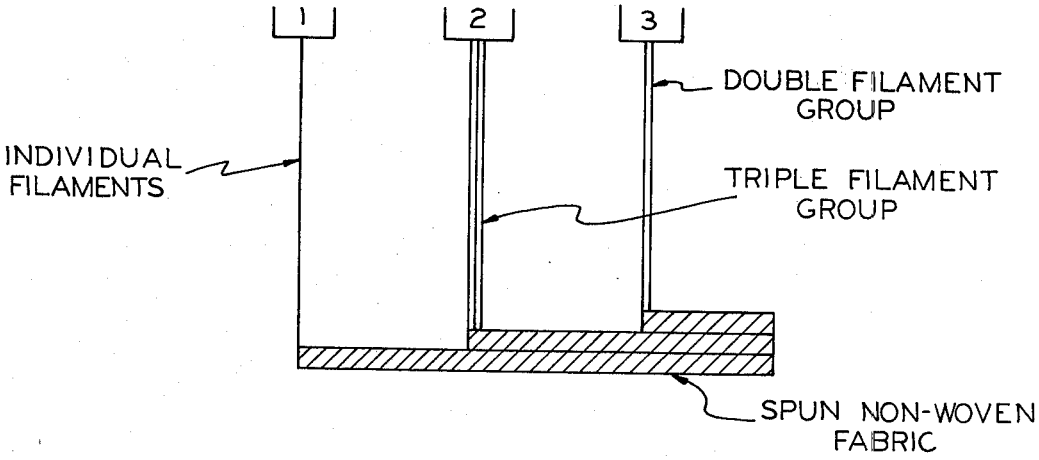

The invention will be further appreciated from the following description together with the drawings, wherein:

FIG. 1 is a plan view of a segment of a spun, non-woven fabric made from polyolefin filaments having polar fibrils and additions of polypropylene oxide adducts; and FIG. 2 is a schematic view of the spinning apparatus for both individual filaments and groups of filaments and the laying thereof to form a spun, non-woven fabric.

FIG. 1 shows schematically at an enlarged scale of about 1:100 a section of a spun, non-woven fabric built up from strongly polar polyolefin filaments. The filaments are deposited by groups, with the filaments in group a composed of non-polar, isotactic polypropylene and other polypropylene filament groups with polar fibrils b of the polypropylene oxide adducts, as well as the individual filaments c distributed therein. These fibrils will be encountered particularly frequently in case of subsequent application of the propylene oxide or ethylene oxide adducts to the so-called parallelized filaments, which are obtained in a group-like extrusion according to U.S. Pat. No. 3,554,854.

FIG. 5 of this patent shows a spun non-woven fabric built up of filament groups, i.e., the fleece is built up of parallel running strands of individual filaments, whereby the parallel filament groups or strands are deposited in tangled position. Such fleeces are used now increasingly as a cover layer of absorbent cellulose layers, for example, in case of diapers, whereby the polyolefin fleece constitutes the outside cover of the cellulose layer. When in use, the polyolefin layer is in direct contact with the skin and is to let through the discharged body fluids so that they may be absorbed by the cellulose layer. These polyolefin fleeces assume the same role in bandages and in tampons. At the same time the porosity of the polyolefin fleeces is an essential feature, in addition to their wettability. The pore size should not be so high that the fluids stored in the layer of cellulose may rewet the fleece, and it should not be so fine that the penetration of the fluids to the layer of cellulose is impeded.

According to the present invention, this task is solved best by mixed fleeces, whereby a spun non-woven fabric is built up of endless, polyolefin filament groups, mixed with individual filaments, wherein the groups consist of individual parallelized filaments. At the same time the groups and individual filaments are deposited in tangled position and are solidified, preferably at their points of crossing. A point reinforcement or thermal reinforcement of defined micro areas by passing the fleece through heated calender rolls provided with raised surface segments is preferred for many purposes.

The structure of the fleece from a mixture of filament groups or parallelized strands with individual filaments is essential because, as a result, the pore size may be adjusted precisely, depending on the requirements. The filament groups are at the same time always composed of two or more parallelized individual filaments, for example, by extrusion from the various spinnerets (FIG. 2) used for the production of the spun, non-woven fabric, which is composed of individual filaments and parallelized filament groups built up into a mixed fleece by intermixing on the deposition belt.

Whenever, for a fleece having a predetermined weight per unit area, the spun, non-woven fabric is built up of only individual filaments (for example, titre 1 dtex), which are deposited tangled, then the flatshaped article has a maximum surface overlap of filaments and minimal pore size. Whenever the same weight per unit area is built up with a fleece, which consists of filament groups each of 10 individual filaments of the same titre, then the flatshaped article will have a very large pore size because the parallelized filament groups or strands, deposited tangled, produce large pores.

Whenever it was desired to close or reduce the pores, several layers would have to be spun one on top of the other and thus greater weights per unit area would have to be produced. This is to be avoided in case of these cover-type fleeces.

By mixing individual filaments with filament groups in a definite number of individual filaments, whereby the mixing ratio of individual filaments and filament groups is selected correspondingly, it will be possible to adjust the pore size of the polyolefin fleece to the value required for the pertinent purpose of use of the fleece. The correct adjustment of the pore size can be adjusted to be close to the praxis in a way wherein it is determined what time (in seconds) is needed for penetration of a certain quantity of fluid through the polyolefin fleece into an absorbent layer (for example, cellulose layer) beneath it, and also the quantity of fluid which later returns to the surface again is ascertained by means of a load pressure from the absorbent layer through the polyolefin fleece (wet-back).

There is a possibility of building up the entire spun, non-woven fabric from similar, polar or outer surface active filaments and filament groups modified thus. On the other hand, however, it is also possible to produce a fleece, built up of two different types of filaments or filament groups (a so-called mixed fleece), in which the filaments and filament groups A consist of non-modified polyolefin and the filaments and filament groups B of polar or outer surface-activated substances. An apparatus for the production of such mixed fleeces is described in U.S. Pat. No. 3,509,009 (FIGS. 17 and 18). In this case, the possibility particularly exists, as shown in FIG. 19 of the above patent, for producing a spun-non-woven fabric which is built up of layers of various kinds of filaments and filament groups.

In the present invention, it is possible at the same time to build up a spun, non-woven fleece with strongly polar surface active filaments and filament groups on the surface of the web and not modified, or only slightly modified, filaments in the middle. The percentage of the surface activity of the individual layers may be raised gradually through the cross section of such a product, whenever, with successively arranged spinnerets, increasingly activated polyolefin is extruded in the running direction, or else whenever the central nozzle extrudes nonmodified polyolefin material (FIG. 2). In the latter case the two flat sides of the fleece are formed from outer surface active filaments.

A further increase and modification of the outer surface activity of the total product may be achieved, by secondarily treating a pre-activated spun, non-woven fabric by a post treatment with tensides. The outer surface active substances are added preferably to zones of the polyolefin filament which have a more strongly polar character, for example, the previously mentioned polar fibrils. Furthermore, however, a preferred addition of the ethylene oxide or propylene oxide adducts takes place between and along the parallel filaments or filament groups. One may use, for example, adducts of the ethylene oxide or propylene oxide on fatty alcohols, mercaptanes, fatty acids or amines. Such substances may be represented by the following patterns, where the long line represents an aliphatic chain.

$$—O—(CH_2—CH_2—O)_x—H$$
$$—S—(CH_2—CH_2—O)_x—H$$
$$—COO—(CH_2—CH_2—O)_x—H$$
$$—NH—(CH_2—CH_2—O)_x—H$$

Also polyglycerine esters of the type $$—COO—(CH_2—\underset{\underset{OH}{|}}{CH}—CH_2—O)_x—H$$

may be used.

Other non-ionogenous, surface active substances of the aliphatic-cyclic type may be used, such as for example, polyethylene ethers of alkyl phenols of the type

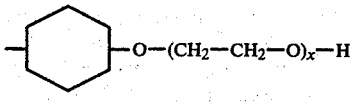

It is easily seen how polyethylene filaments, or the spun, non-woven fabrics made therefrom, are completely or partly modified on the surface with these ethylene oxide adducts, whereby the pure polyethylene chains lie inside the filaments and the polar polyethylene oxide chains or adducts on or near the filament surface.

The increase of the outer surface activity of the filaments making up the spun, non-woven fabrics by application of the above mentioned non-ionogenous chemicals must be controlled at the same time, depending on whether the outer surface activity is to be maintained to aid in wetting, or whether the outer activity is to be reduced in case of intensive contact with water or an aqueous liquid. In various cases in practice it is desirable, e.g., in spun, non-woven fabrics used as cover layers of highly absorbent cellulose in diapers or medical bandages, that after initial good wettability the latter is reduced in order to prevent too much soaking. In this case the surface activity of the outer surface active layer is to be flushed away or transferred into the cellulose layer, whereby then the layer of spun, non-woven fabric becomes increasingly hydrophobic. In such case it may be of advantage to provide the outer surface activity by application of the oxygen-containing, non-ionogenous polypropylene oxide polymerizates or polyethylene oxide polymerizates onto the mixed fleece of polyolefin filament and/or filament groups. As has already been mentioned previously, porosity is adjusted by the mixing ratio of individual filaments to filament groups and the degree of wetting by the ethylene oxide or propylene oxide adducts. The penetration time of liquids and the wet back of liquids is adjusted by a balancing of both factors.

EXAMPLE 1

A tangle fleece of intermixed polypropylene individual filaments and polypropylene filament groups was produced with the apparatus described in U.S. Pat. No. 3,554,854 (FIG. 2). According to the apparatus, which is shown schematically herein in FIG. 2, individual filaments and filament groups were extruded from adjacent spinnerets. All were drawn by means of aerodynamic jet units through air channels and then were fed to a receiving belt and deposited into a tangled fleece. A corresponding arrangement of the nozzles with groups of 3 spinning holes is shown in the above mentioned U.S. Pat. No. 3,554,854 (FIG. 3). Here the adjacent nozzles always have single or double orifice rows in order to spin single filaments or double filament groups. The spinning process is carried out such that a weight by unit area of 15 g/m$^2$ consisting of 50% individual filaments and at least always 25% double or triple groups, was produced. Individual filament titre amounted to 1.5 dtex (mean value). The nozzle temperature was adjusted to 250° C. As a spinning raw material, polypropylene with the melt index Mi of 12–17 (230°) was used, measured according to German Standard DIN 53 735. Prior to spinning, 1% titanium dioxide and 0.3% optical brightener (uvilex of the firm Ciba) was added to the polypropylene. After deposition of the fleece, the still non-bonded fleece was sent through a calender at 120°, one steel roll of which had raised pyramids of 1 mm diameter and a distribution of 32/cm$^2$, so that a point bonding of the fleece at 18% embossed surface took place. Subsequently it was saturated with an aqueous solution of isooctyl-phenol-polyethoxyethanol which contained 10 mole of ethoxy groups (for example, Triton X-100 of the firm Rohm & Haas). After saturation the fleece was dried with the help of a drum dryer with perforated drum while being ventilated by air at 100°. The pore size and wettability was measured by liquid penetration in both directions (re-wet). In this case, 30 cm$^3$ of a 15% urea solution were applied to the resultant fleece, which was supported by a cellulose layer. After penetration of the fluid a filter paper of 18 cm diameter was put on the fleece. A load of 3,000 g. was applied to the cellulose layer. After 3 minutes of loading the filter paper was weighed, and the quantity of liquid was determined which had forced its way back through the polyolefin fleece from the cellulose layer into the filter paper. This quantity is less than 1 cm$^3$. The speed of the original penetration was found to be less than 2 minutes.

EXAMPLE 2

In this example the spinning process was carried out as in Example 1. The ethylene oxide adduct together with the $TiO_2$ and the optical brightener were added prior to extrusion in a quantity of 1% to the polypropylene oxide granulate. In this case a block-polymer of the type $$HO(CH_2-CH_2-O)_x-(\underset{\underset{CH_3}{|}}{CH}-CH_2-O)_y-(CH_2-CH_2-O)_z-H$$

was used with 50% polyoxyethylene units in the molecule and a mean molecular weight of 6500 (Pluronic P 105 of the firm BASF Wyandotte Corp.). The rest of the molecule was built up of polyoxypropylene units. It turned out that the combination of ethylene oxide and propylene oxide adducts in one molecule results in particularly favorable characteristics for the present invention. As a result of the percentage of polymerized ethylene oxide in block-polymers of the propylene oxide, the hydrophilic condition may be adjusted well, since the polymerized propylene oxide in comparison has more hydrophobic characteristics. As a result the degree of water-solubility of the adduct on the polyolefin filaments or filament groups may be adjusted. If, with covering fleeces for diapers, one would want to prevent a wet-back of the fluid (urine) from the cellulose absorbing layer, it is advantageous to use higher proportions of ethylene oxide vis-a-vis the propylene oxide block. Then the adduct is more water soluble and more readily flushes off the polyolefin; in case of wetting, an increasing hydrophobic condition develops. As a result the body-contacting surface of the diaper remains dry. A quantity of over 20% ethylene oxide in the molecule is preferred. After bonding of the fleece, no further adduct was added.

The speed of penetration of the fluid in this case was somewhat lower than in the preceding example because less than the entire quantity of adduct had migrated to the surface of the filaments.

The aliphatic chains (chiefly alkyl and alkenyl) designated by the horizontal lines in the foregoing formulae preferably have at least 5 carbon atoms. The practical upper limit is about 20–22 carbon atoms. The alkyl group of the alkyl phenol radical may have 1–20 carbon atoms, the optimum being about 6–10 carbon atoms. The subscript x of the radical $-(C_2H_4O-)_x$ in the above formulae is at least about 5. The upper limit is in the order of 100—keeping in mind that the longer is the polyoxyethylene glycol chain, the more water soluble is the compound. In the case of polyoxypropylene polyoxyethylene glycols such as in formula C and in Example 2, above, the sum of x and z is at least 0.2 y and up to about 10 y. The subscript y may range from about 10 to about 100.

The invention is claimed as follows:

1. Spun, non-woven fabric from bonded polyolefin filaments deposited in a random pattern, characterized by a mixture of individual filaments and filament groups of at least two parallelized, individual filaments wherein at least portions of the individual, polyolefin filaments and the polyolefin filament groups are modified by polar groups.

2. Spun, non-woven fabric as claimed in claim 1, characterized by the individual filaments and the filament groups being modified at least partially with ethylene oxide and/or propylene oxide adducts.

3. Spun, non-woven fabric as claimed in claim 2, characterized by the ethylene oxide and/or propylene oxide adducts as fibrillae on filament and/or filament group surfaces.

4. A liquid-absorbent material useful for diapers, bandages or tampons comprising a layer of liquid-absorbent, fibrous material having bonded thereto a spun, non-woven fabric as set forth in claim 3.

5. A liquid-absorbent material useful for diapers, bandages or tampons comprising a layer of liquid-absorbent, fibrous material having bonded thereto a spun, non-woven fabric as set forth in claim 2.

6. Spun, non-woven fabric as claimed in claim 1, characterized by the polar groups whose concentration increases toward one surface of the fabric.

7. Spun, non-woven fabric as claimed in claim 1, characterized by surface applied ethylene oxide adducts of propylene oxide block polymers with at least 20% by weight of ethylene oxide applied to the surface of the filaments.

8. A liquid-absorbent material useful for diapers, bandages or tampons comprising a layer of liquid-absorbent, fibrous material having bonded thereto a spun, non-woven fabric as set forth in claim 7.

9. A process for the production of spun, non-woven fabrics as set forth in claim 1, wherein parallel filaments and groups of filaments are extruded from a multiplicity of spinnerets, which are then deposited in tangled random fashion as a mixed fleece of individual and groups of parallelized filaments, and during or after extrusion, adducts of propylene oxide and/or of the ethylene oxide are added to the filaments and/or filament groups, and the mixed fleece thus produced is bonded by autogenous bonding.

10. A process as claimed in claim 9, wherein block polymers with propylene oxide are used as ethylene oxide adducts.

11. A process as claimed in claim 9, wherein the propylene oxide and/or ethylene oxide adducts are applied on the filaments or filament groups which comprise a surface of the fleece.

12. A process as claimed in claim 9, wherein the pore size of the spun, non-woven fabrics is adjusted by the mixing in tangled random fashion individual filaments and filament groups, and the filament groups consist of at least two, parallelized, individual filaments.

13. A process as claimed in claim 9, wherein the ethylene oxide adducts are used with at least 20% by weight of ethylene oxide.

14. A liquid-absorbent material useful for diapers, bandages or tampons comprising a layer of liquid-absorbent, fibrous material having bonded thereto a spun, non-woven fabric as set forth in claim 1.

* * * * *